US006712546B1

(12) United States Patent
Radu, Jr. et al.

(10) Patent No.: US 6,712,546 B1
(45) Date of Patent: Mar. 30, 2004

(54) POLYMERIC FORMS FOR MOLDABLE BUILDING MATERIAL STRUCTURES

(76) Inventors: John Radu, Jr., 1700 Brittainy Oaks Trail, NE., Warren, OH (US) 44484; George A. Radu, 8286 Pebble Creek Ct., Chagrin Falls, OH (US) 44203; Wesley A. Schroeder, 9011 Guilford Rd., Seville, OH (US) 44273

( * ) Notice: Subject to any disclaimer, the term of this patent is extended or adjusted under 35 U.S.C. 154(b) by 47 days.

(21) Appl. No.: 09/924,296

(22) Filed: Aug. 8, 2001

(51) Int. Cl.[7] ..... E01C 11/22
(52) U.S. Cl. ..... 404/8
(58) Field of Search ..... 404/7, 8; 249/1, 249/2, 3, 4, 5, 6, 7, 8, 188, 164, 210, 9; 264/35; 362/153, 153.1

(56) References Cited

U.S. PATENT DOCUMENTS 3,567,171 A * 3/1971 Slominski ..... 249/9
4,762,438 A * 8/1988 Dewing ..... 404/7
4,901,492 A * 2/1990 Coates ..... 52/300
5,015,117 A * 5/1991 Pawlicki ..... 249/6
5,332,191 A * 7/1994 Nolan ..... 249/9
6,123,443 A * 9/2000 Conway ..... 52/102
6,195,956 B1 * 3/2001 Reyneveld ..... 264/163
6,409,422 B1 * 6/2002 Mittermaier et al. ..... 404/8

OTHER PUBLICATIONS

"Red–E–Form Island Forms" Riverside Steel, Inc., (1989–1998) product brochure.

* cited by examiner

*Primary Examiner*—Michael Safavi
(74) *Attorney, Agent, or Firm*—Renner, Kenner, Greive, BoBak, Taylor & Weber

(57) ABSTRACT

A form for formable building material structures including a plurality of polymeric segments coupled to one another to define a cavity for receiving the formable building material therebetween.

10 Claims, 15 Drawing Sheets

POLYMERIC FORMS FOR MOLDABLE BUILDING MATERIAL STRUCTURES

TECHNICAL FIELD

In general, the present invention relates to polymeric, permanent, forms for formable building materials. More particularly, the present invention relates to permanent forms used in conjunction with formable building materials to support fuel dispensers, ATM machines, and poles bases, walkways, handicap ramps, building and kiosk forms, among others.

BACKGROUND OF THE INVENTION

Presently, metal forms are used in connection with formable building materials to mold permanent structures. As one example, steel forms are used to create concrete islands or pedestals for fuel dispensing pumps, ATM machines, lighting pole bases, walkways, handicap ramps, building and kiosk forms, and other such structures. These forms typically have an outer and inner wall. The outer wall defines the shape of the structure while the closed form inner wall defines a cavity in which the concrete is poured and hardened to form the island. Typically the closed form inner wall has a skeletal frame supported by cross a member extending therebetween. Since each site where the form is installed presents a different environment, the forms may need to be cut and rewelded to accommodate obstructions or other irregularities found at the site.

The formed concrete structure or island, once completed, provides structural support and helps to protect the devices that are supported on it acting as a barrier against impact. To perform this function, the forms are typically constructed to have a height of at least six inches above the ground. The forms have several designs from simple geometric island shapes, such as ovals or rectangles to more complex shapes, such as those used in fuel dispensing applications, including so-called Dogbone® "bar-bell", or "bowtie" styles. The more complex shapes were developed with wider ends and more narrow center sections, to force vehicles outward as they approached, while providing space to open the vehicle door once parked.

As previously mentioned, the outer wall of these forms is typically constructed of steel. The steel forms are susceptible to corrosion and, thus, are often painted. The forms are then periodically repainted as a result of wear or fading. The steel frames are quite heavy and, since they are welded prior to delivery, can be cumbersome to handle and install.

Consequently, there is a need for a form that improves over the prior art by being more corrosion resistant, having less weight, being of modular construction, such that it may be easily assembled and leveled on site, and having enhanced surface appearance and life.

SUMMARY OF THE INVENTION

It is therefore, an object of the present invention to provide a form constructed of polymeric material. It is a further object to provide a form constructed of molded polymeric members. It is still a further object that the molded polymeric members be modular such that the form may be easily assembled and leveled on site.

In general, the present invention provides a form for formable building material structures including a plurality of polymeric segments coupled to one another to define a cavity for receiving the concrete, or other formable construction material.

The present invention further provides a form for formable building material structures including at least one hollow polymeric segment, the segment having an outer surface and an inner surface spaced radially inwardly from the outer surface by top and bottom surfaces, where the inner surface transcends a pair of ribs vertically spaced from each other by a well defined by opposed sides of the ribs and a connecting surface therebetween.

The present invention further provides a segment coupling assembly in a segmented form for moldable building materials, the form having a pair of ribs separated by a well, the segment coupling assembly comprising: an insert supported on each segment between said ribs to span said well, said insert defining a coupler receiving opening; and a coupling member received in said opening on at least two segments and adapted to couple said two segments to one another.

DETAILED DESCRIPTION OF THE INVENTION

Figure 1:
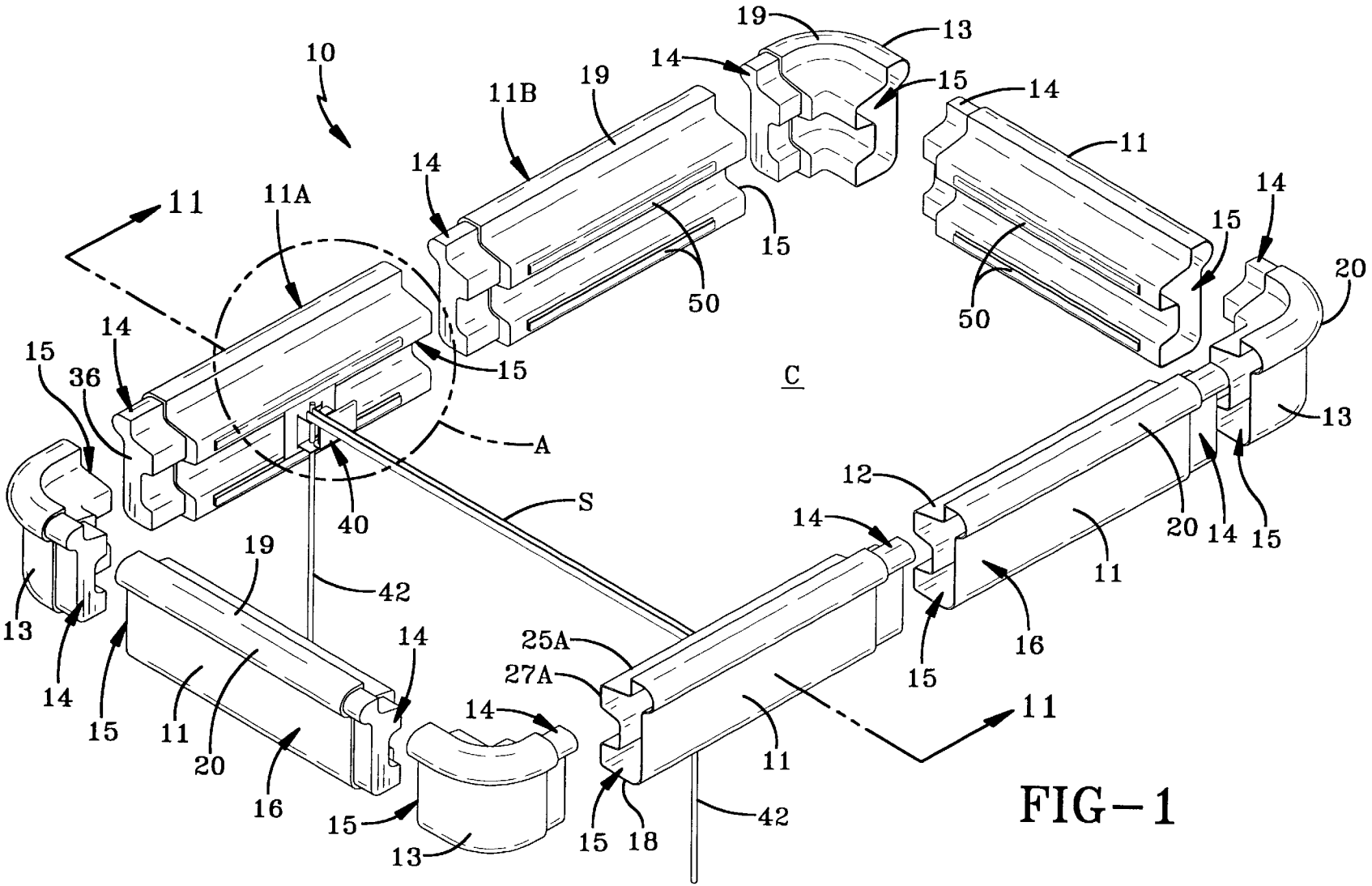
FIG. 1 is an exploded view of a polymeric form for concrete structures according to the present invention depicting side segments, end segments and arcuate segments joined to define a form for receiving concrete with the form anchored by an anchor assembly.

A form for formable building material structures, generally indicated by the numeral 10, is shown in the accompanying figures. The form 10 has an inside surface 12 that defines a cavity C in which formable building material M is received. Initially, the material M is in a liquid state and gradually gets to a solid state taking on the shape of cavity C. The form 10 may be left to form an outside barrier surrounding the hardened material M and, thus, is referred to as a permanent form in the industry. There are many formable materials M that are commercially available and used in the industry in conjunction with a form 10 including but not limited to asphalt, concrete, shotcrete, fiber reinforced concrete, and other cementitious materials. All of these materials M may be suitably formed by the form 10 and are included within the definition of formable material M as used to in this description. To provide a light-weight structure for forming material M, the form 10 may be constructed of polymeric material, such as olefins including polypropylene and polyethylene, and polyamides, including nylon. Form 10 is of any desirable shape, which may be determined by the particular application for the form 10, including, for example, oval, bowtie, barbell, Dogbone®, or rectangular shapes, often used in fuel dispensing island applications. It will be appreciated that the form 10 may define a cavity C of any shape including geometric shapes or custom shapes as desired by the ultimate consumer. As shown in FIG. 1, the form 10 may be constructed of a plurality of segments including side segments 11, and corner segments 13. The segments 11, 13 may be of any shape or configuration and include straight and curved portions. Reference to side sections 11 and corner sections 13 are made to simplify the description and are not limiting. To assemble the form 10, the segments 11 and 13 may be coupled by fasteners, adhesives, or other suitable methods, including the interlocking of segments 11, 13 as shown in the figures. By way of example, as shown in FIG. 1, a male portion 14 of one side segment 11 A may be slidably received within the female portion 15 of the adjacent corner section 13. To more permanently fix these joints, mechanical fasteners and devices may be used and/or a glue or epoxy may be applied to each end 14, 15 as will be described more completely below.

By constructing the form 10 of multiple segments, the form 10 is more flexible in terms of its ultimate application. For example, the size of form 10 may be altered by adding or removing segments as appropriate. Further, the disassembled segments may be more easily transported than a completed form 10. These segments, once on site, would be assembled to create a complete form 10.

To provide rigidity suitable for retaining material M, form 10 is constructed with a reinforced profile. In general, the reinforcing profile is characterized as being nonlinear having at least one inwardly projecting surface. The projecting surface may take on number of shapes including various geometric shapes. Therefore, the particular shape of the inwardly projecting surface is not considered limiting and may be a function of the particular material to be used. To simplify the description, the inwardly projecting surface will be referred to as a rib. As will be described more completely below, multiple inwardly projecting surfaces or ribs may be used in accordance with the present invention. As will be understood, it is preferred, when using such ribs, to maximize the moment of inertia of the form 10 while minimizing the amount of material used to create the form 10.

Figure 2:
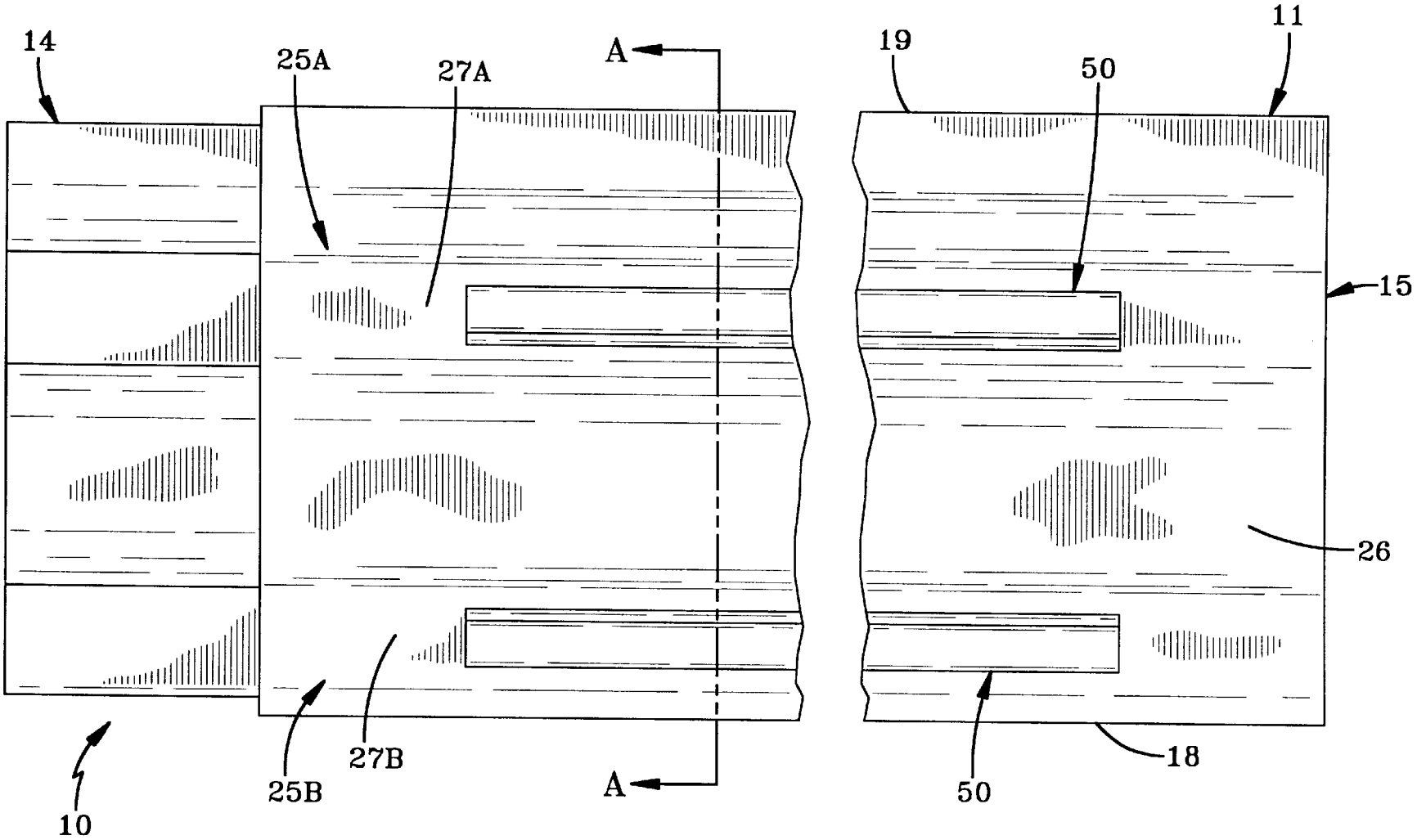
FIG. 2 is side elevational view of a segment in a form according to the present invention having rails located thereon.
Figure 2A:
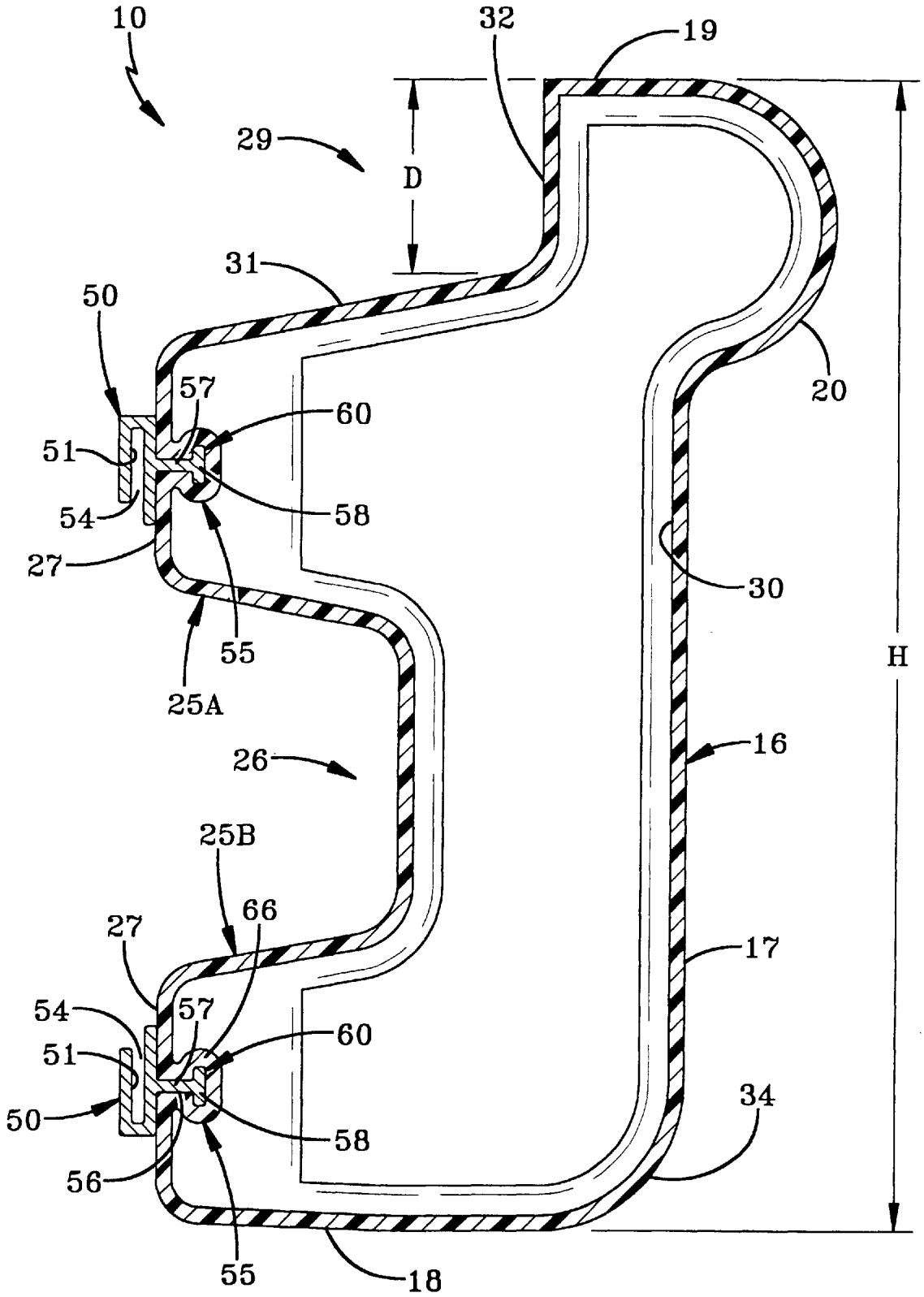
FIG. 2A is a sectional view as might be seen along line A—A in FIG. 2 depicting the attachment of the rails in greater detail.
Figure 4:
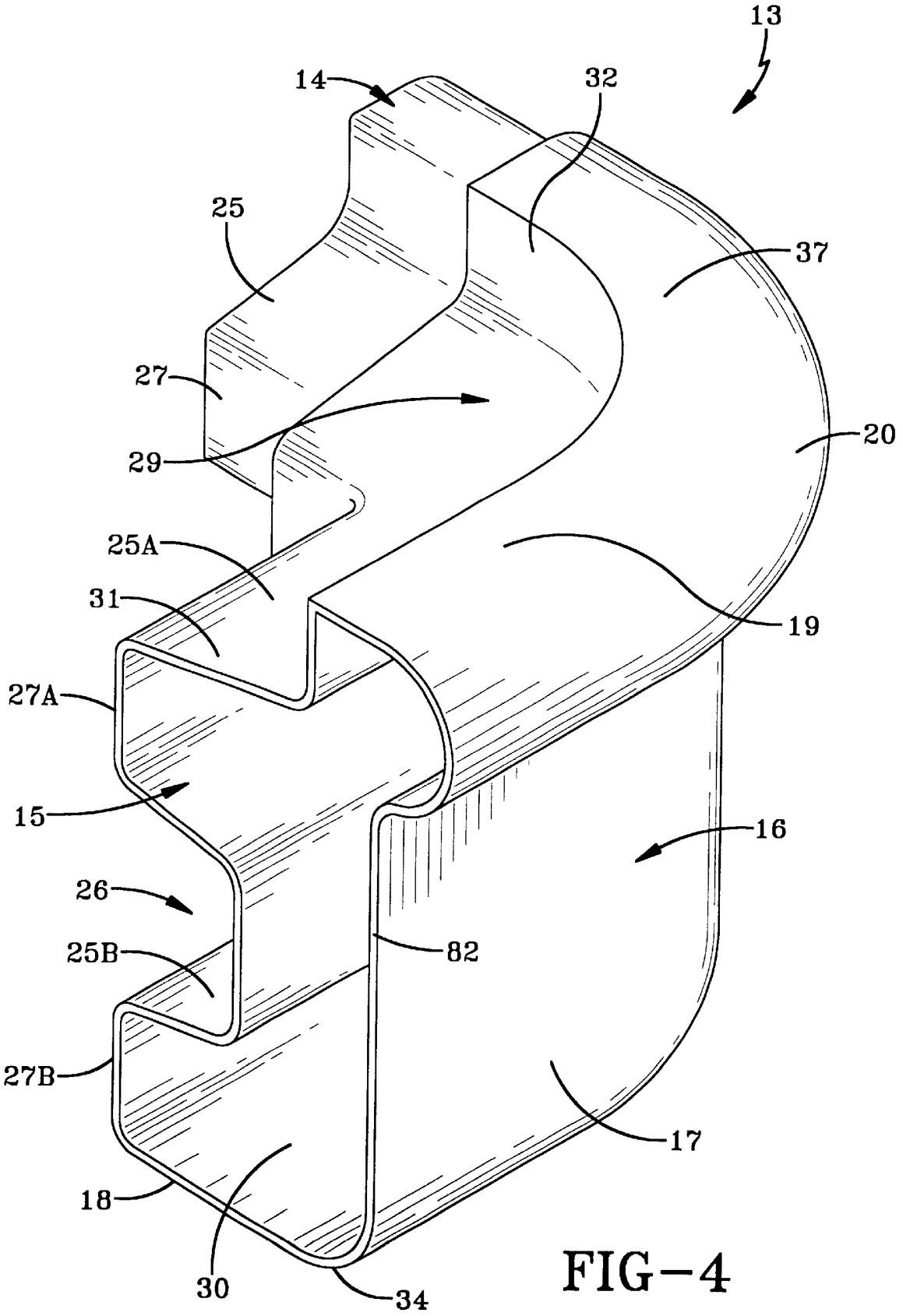
FIG. 4 is perspective view of an arcuate segment in a form according to the present invention enlarged to show greater detail thereof.

As best shown in FIG. 2A, the exposed surface 16 of form 10 resembles a typical concrete form having a generally planar lower portion 17 with an overhanging rim 20. Within the inner portion of the form 10, the form 10 is provided with one or more reinforcing ribs 25. Ribs 25 may be tapered inwardly toward an inner rib wall 27 spaced inwardly from the exposed surface 16 of the form 10. As will be understood, the taper facilitates manufacturing of form 10. In the embodiment shown in FIG. 4, a pair of ribs 25A, 25B project inwardly from the segments 11 and 13. The first rib 25A is located at a distance D below the top surface 19 of the rim 20 such that, when the material M is poured, a layer of formable material M fills the generally L-shaped recess 29 formed between the inner wall 31 of the rib 20 and the upper side wall 32 of reinforcing rib 25A. The recess 29 aids the installer in filling the form 10 without overflow and helps to prevent cracking of the material commonly found in prior art systems where a planar form is used. The top surface 19 of the rim 20 may be made level to facilitate the pouring and leveling of the concrete within the form 10. The lower rib 25B is generally similar to rib 25A having a taper toward its inner rib wall 27B. Since the lower reinforcing rib 25B may rest on the ground, as shown in FIG. 1, the lower surface may be made level to allow the form 10 to lay flush on a supporting surface. The transition between the exposed surface 16 of the form 10 and the lower reinforcing rib 25B, may be eased with the use of a corner round 34.

Since the form 10 is constructed of a polymeric material, it is lighter than a steel form, of similar dimension. To further reduce the weight of the form 10, its segments may be made hollow, thus defining a bore 30. Bore 30 may generally conform to the cross sectional shape of the form 10 and may be closed by an end cap 36 formed on the male portion 14 of each segment. As best shown in FIG. 2, the bore 30 is truncated to an extent at the male portion 14 of a segment, due to the dimensional reduction necessary to fit the male portion 14 within the female portion 15 of an adjacent segment.

In terms of individual segments, the cross section of each segment 11, 13 is generally the same to provide continuity in the form 10. The arcuate segments 13 shown in FIG. 4 may have an L-shape configuration with an intermediate portion 37 joining the male and female portions 14, 15, which are opposed substantially at a right angle. The intermediate portion 37 may be square or rounded as shown. It will be appreciated that due to the transition at an arcuate segment, the cross section may be varied as necessary. While a 90° arcuate section 13 is shown, it will be appreciated that arcs tracing any angle may be formed as necessary for the form 10, such as the ends of a barbell form. Further, the length of the intermediate portion 37 may be varied to achieve the appropriate shape of the form 10. As in the case of other segments, the arcuate corner segments 13 may be provided with interlocking portions 14, 15 in a configuration other than the male/female configuration shown. It will be appreciated that a segment may have two male ends or two female ends such that an intermediate segment having the opposite type of end is used to join adjacent segments. In fact, a coupler (not shown) with the appropriate ends may be provided to join adjacent ends of the same type such as a male or female juncture.

To facilitate transport, the form 10 may be constructed at the site, such that the individual segments may be boxed or otherwise transported for assembly. Appropriately shaped segments would be provided for a desired form 10 or customized forms 10 may be constructed by assembling necessary segments at the site. The form 10 is laid out to perform its function, such as protecting and elevating fuel pumps. To that end, the form 10 may be laid out on a supporting surface such as the ground and once the desired shape is obtained, the segments 11, 13 would be mechanically fastened and/or glued if necessary.

Figure 7:
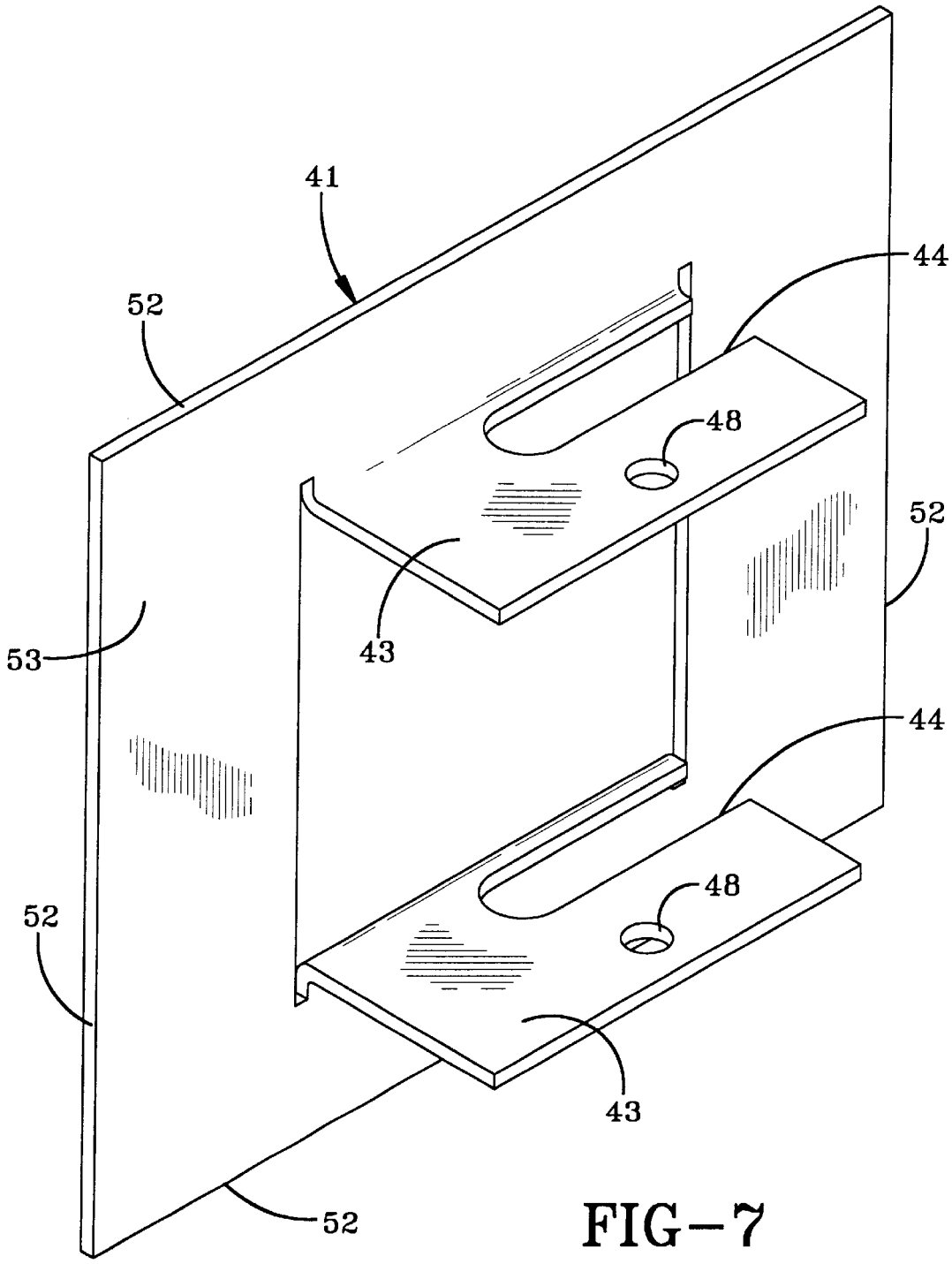
FIG. 7 is an enlarged perspective view of a bracket in the anchor assembly enlarged to show greater detail.
Figure 8:
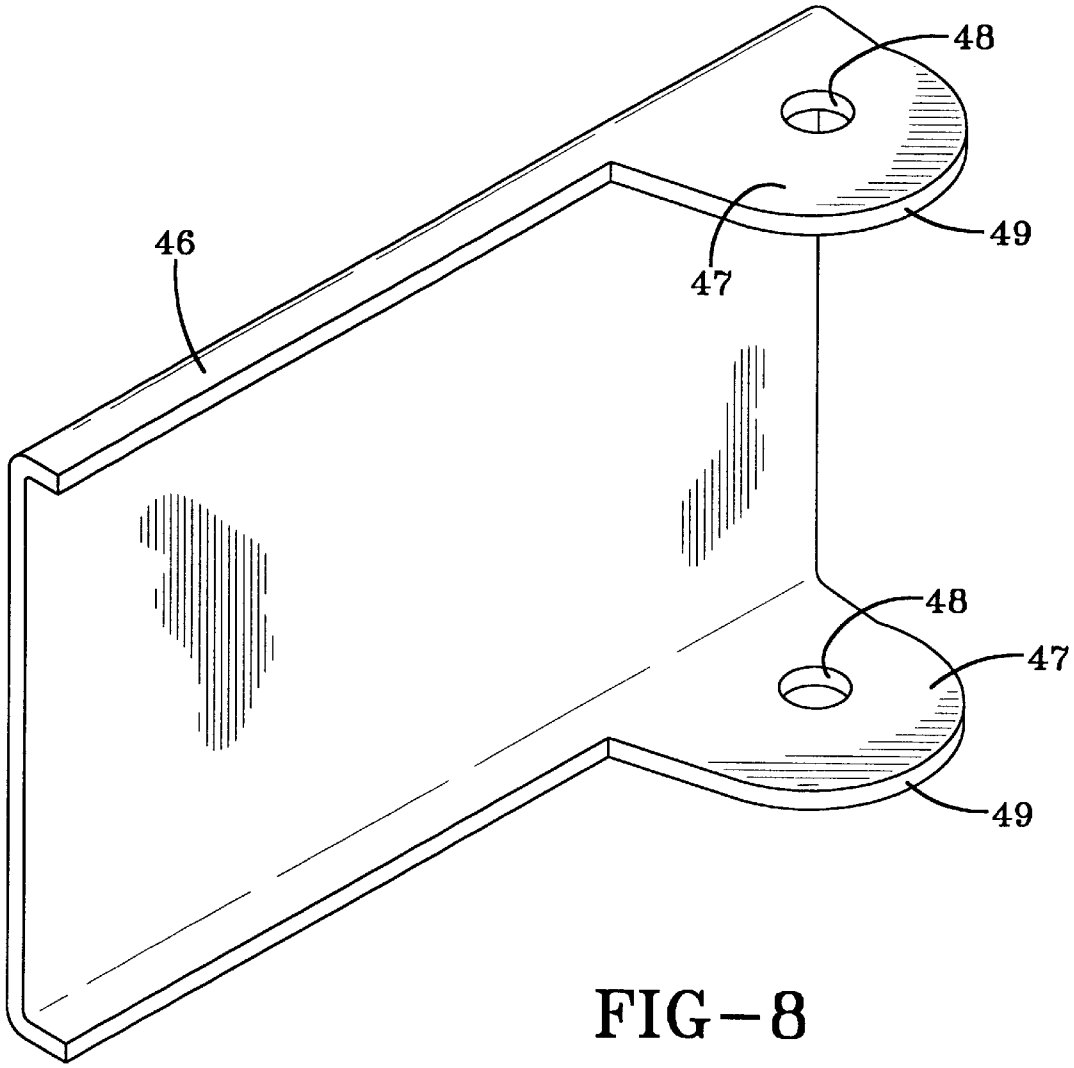
FIG. 8 is a perspective view of a lever lock assembly according to the present invention enlarged to show greater detail thereof.

An anchor assembly 40 is provided for leveling and to restrict movement of the form 10 during installation. Anchor assembly 40 may include an anchor bracket 41, which may be constructed of metal (FIG. 7) and attached to the interior surface of the form 10, such as inner rib walls 27. Anchor bracket 41 is provided with a receiver 44 to allow for some adjustment of the position of anchor member 42 in which an anchor member 42, such as a rod, a threaded member, or reinforcement bar is received. Receiver 44 may be an opening to allow for some adjustment of the position of anchor member 42 or slot as shown. Receiver 44 may be formed on a pair of bracket arms 43 extending inwardly from the base 53 of the bracket. Bracket arms 43 may be stamped from the base and have a slot type receiver 44 near to the base 53. In that regard, the bracket arms 43 may be characterized as having an L-shape.

A locking assembly 45 may be provided to fix the anchor member 42 within receiver 44. A number of suitable mechanisms available in the art, including fasteners or clamps, may be used to hold the anchor member 42 within receiver 44.

Figure 6:
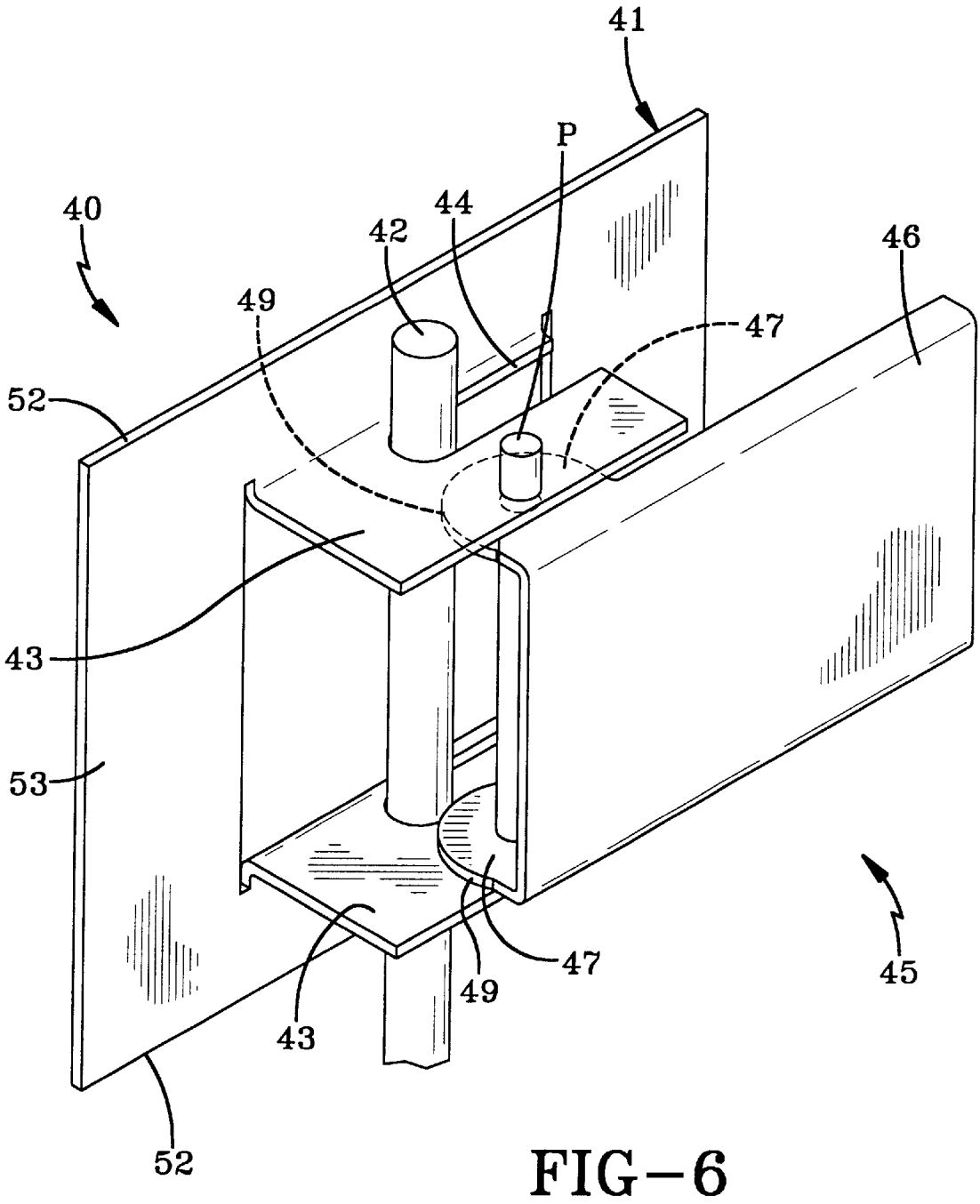
FIG. 6 is an enlarged perspective view of the anchor assembly removed from the rails on a segment to show greater detail of the anchor assembly.

In the embodiment shown in FIG. 6, a lever-type locking assembly 45 is used to apply a clamping force holding the anchor member 42 in receiver 44. The locking assembly 45 includes a lever arm 46 pivotally attached to the bracket 41, as by a pin P, and is generally located adjacent to receiver 44 such that upon actuation, it applies a clamping force to the anchor member 42 to hold the anchor member 42 within receiver 44. Lever arm 46 is provided with lock arms 47 that extend toward the anchor member 42 and may extend in a plane perpendicular to the plane of the lever arm 46, as shown. Lock arms 47 may be located within bracket arms 43 and each provided with corresponding pin receivers 48 to accept the pin P and pivotally couple lever arm 46 to bracket 41. While the embodiment depicted has two arms 47 used to create locking contact at two points, it will be appreciated that one or more contact points may be used. In the embodiment shown a pair of locking arms 47 are spaced from each other and grasp the anchor member 42 at two points. Lock arms 47 are provided with a cam-like edge 49, which may generally be semi-circular, that applies the greatest clamping force when in its locked position (FIG. 6). As shown in FIG. 6, when edges 49 are in the locked position they effectively trap the anchor member 42 within receiver 44. By rotating the lever arm 46 toward the unlocked position, the force applied to the anchor member 42 is reduced and the cam-like lock edges 49 clear the anchor member 42 such that it may be moved within receiver 44, Vertical adjustment of the form 10 may be attained by releasing anchor member 42 and moving the segments vertically to the desired position. Once the proper height has been attained, the locking assembly 45 is used to hold the form 10 relative to the anchor member 42.

It will be appreciated that this horizontal adjustment of the bracket 40 relative to the anchor member 42 allows for horizontal adjustment of the individual segments or the entire form 10, as necessary. To provide horizontal adjustment, bracket 40 may be slidably received on a rail (FIG. 9), generally indicated by the numeral 50, which may be made of metal as shown in FIG. 2A. Rail 50 may be formed to define a bracket receiver 51 that slidably receives at least a portion of the bracket 41 such as its edge 52. In that respect, the rails 50 may be provided with a slot-form receiver 51 having a mouth 54 to receive the edge 52 of a planar bracket base 53. When a pair of opposed rails 50 are used the mouths 54 of each rail 50 would face each other. Opposite edges 52 of the base 53 would be slidably received, between the proposed rails 50. With the bracket 41 so mounted, the horizontal position of the form 10 for the individual segments 11, 13 may be adjusted by sliding the segments 11, 13 or form 10 relative to the anchor assembly 40. Ordinarily, the position of the anchor member 42 is generally fixed because the anchor member 42 is driven into the ground or otherwise attached to a supporting surface . It will be appreciated that similar adjustment of the form or segment position may be made by moving the anchor member 42 relative to the form 10. If necessary to accommodate this movement, the bracket 41 could be slid along the rails 50. Thus, the form 10 may be positioned vertically and horizontally in the desired position and modified through the use of segments to achieve the appropriate configuration for the particular site without resorting to rewelding or producing a new form.

Figure 5:
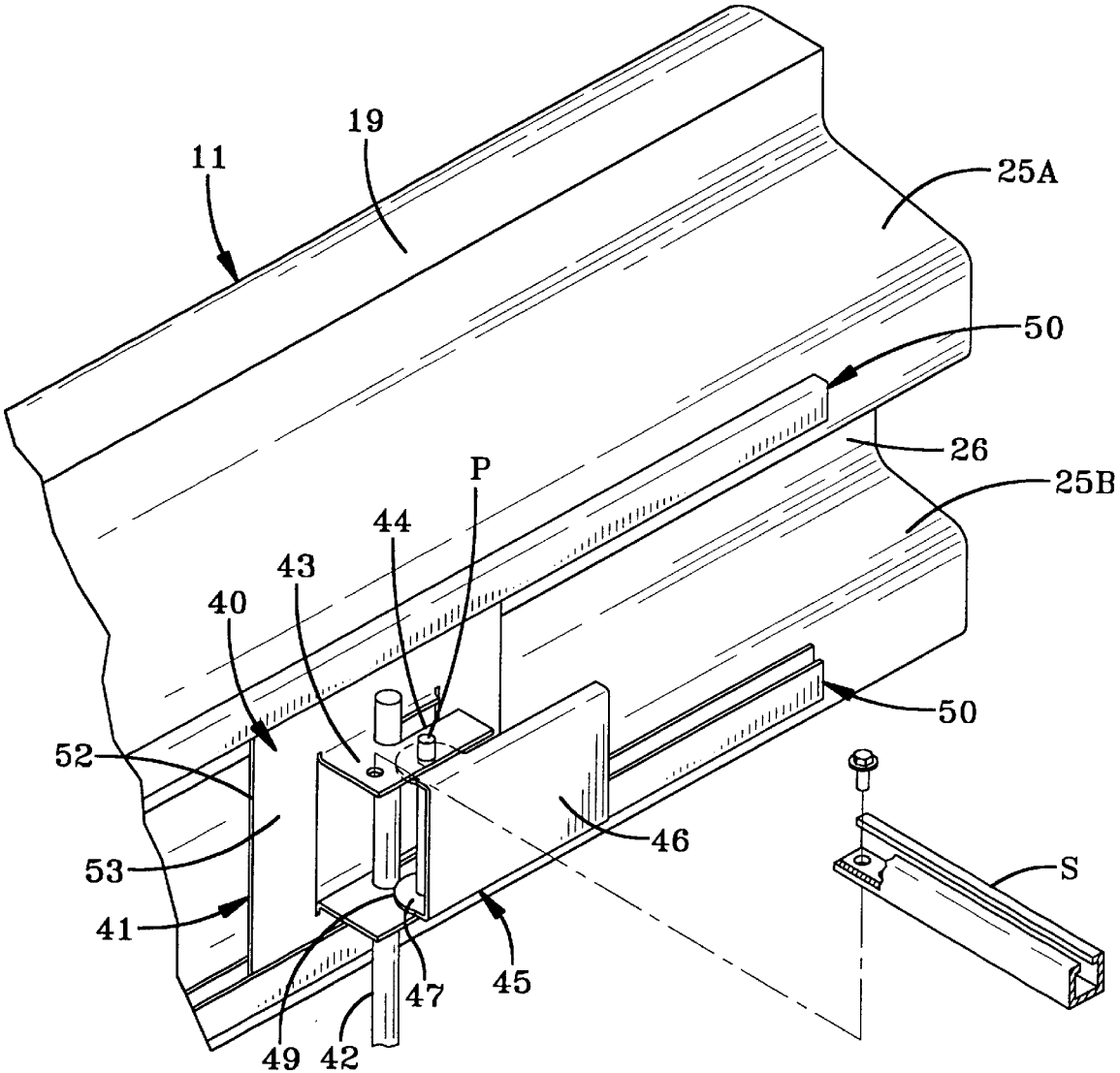
FIG. 5 is an enlarged perspective view of the circled area indicated by the letter A in FIG. 1 depicting the anchor assembly in greater detail.

The anchor bracket 40 may be used to attach other members to the segments 11, 13, including braces, a support members, or other members used to suspend items within the cavity C, such as a Power Strut System® S (FIG. 5). In addition, the segments 11, 13 may be used in conjunction with the Power Strut System® S to suspend items within the cavity C. In a fuel dispenser application, such items may include dispenser mounting boxes, containment sumps, or conduit for gases, liquids, or wiring.

The rails 50 may be integrally molded into or suitably attached to the form 10 such that the anchor assembly 40 is housed within the form 10. The rails 50 may be attached by suitable commercially available methods including fasteners, adhesives, or resilient snap fasteners. As shown in FIG. 2*a*, the inner rib walls 27 of reinforcing ribs 25 may define a rail receiver, generally indicated by the numeral 55. Rail receiver 55 includes a generally T-shaped recess 56 which has a mouth 57 forming the lower portion of the T and a base portion 58 forming the upper portion of the T. In general, the mouth portion 57 is sized smaller than the base portion 58 such that a tab, generally indicated by the numeral 60, received within recess 56 is prevented from withdrawing inwardly from receiver 55. It will be appreciated that receiver 55 of this type may be used such as an L-shaped recess 56.

Figure 9:
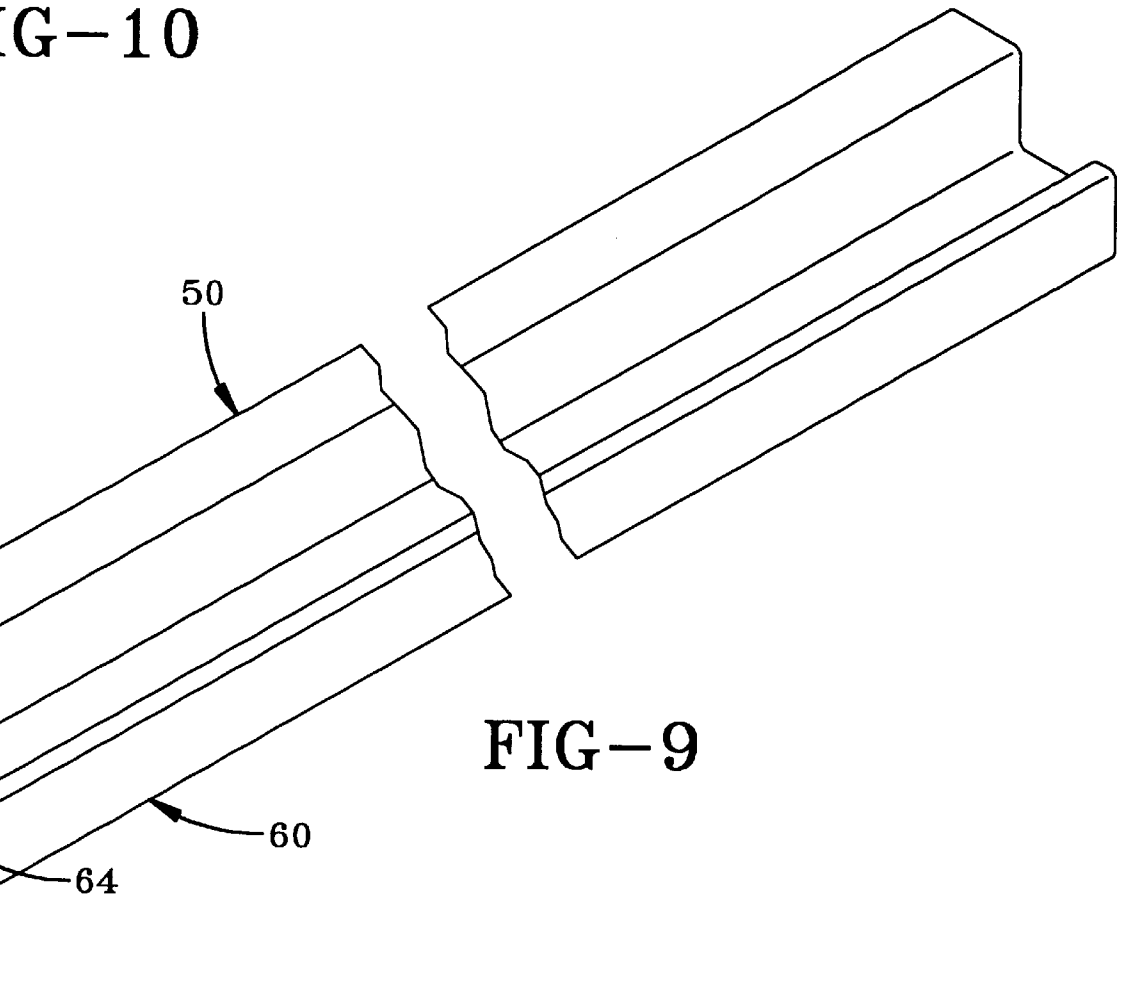
FIG. 9 is a perspective view of a rail used to attach the anchor assembly to the segment.
Figure 10:
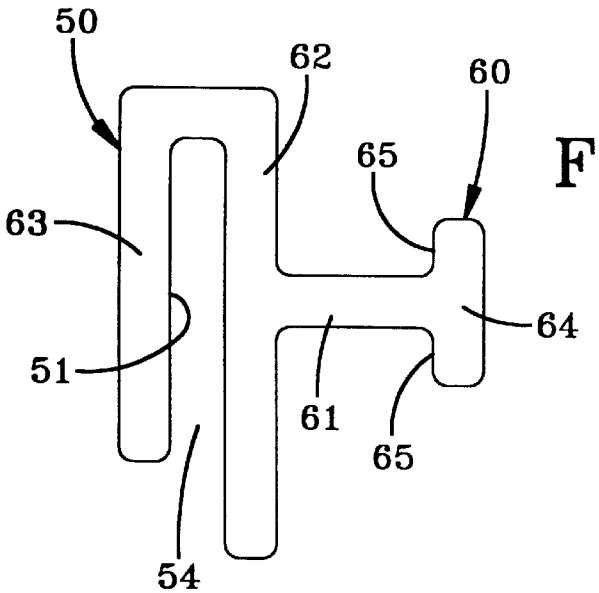
FIG. 10 is an end view of a rail similar to that depicted in FIG. 9, enlarged to show greater detail thereof.
Figure 11:
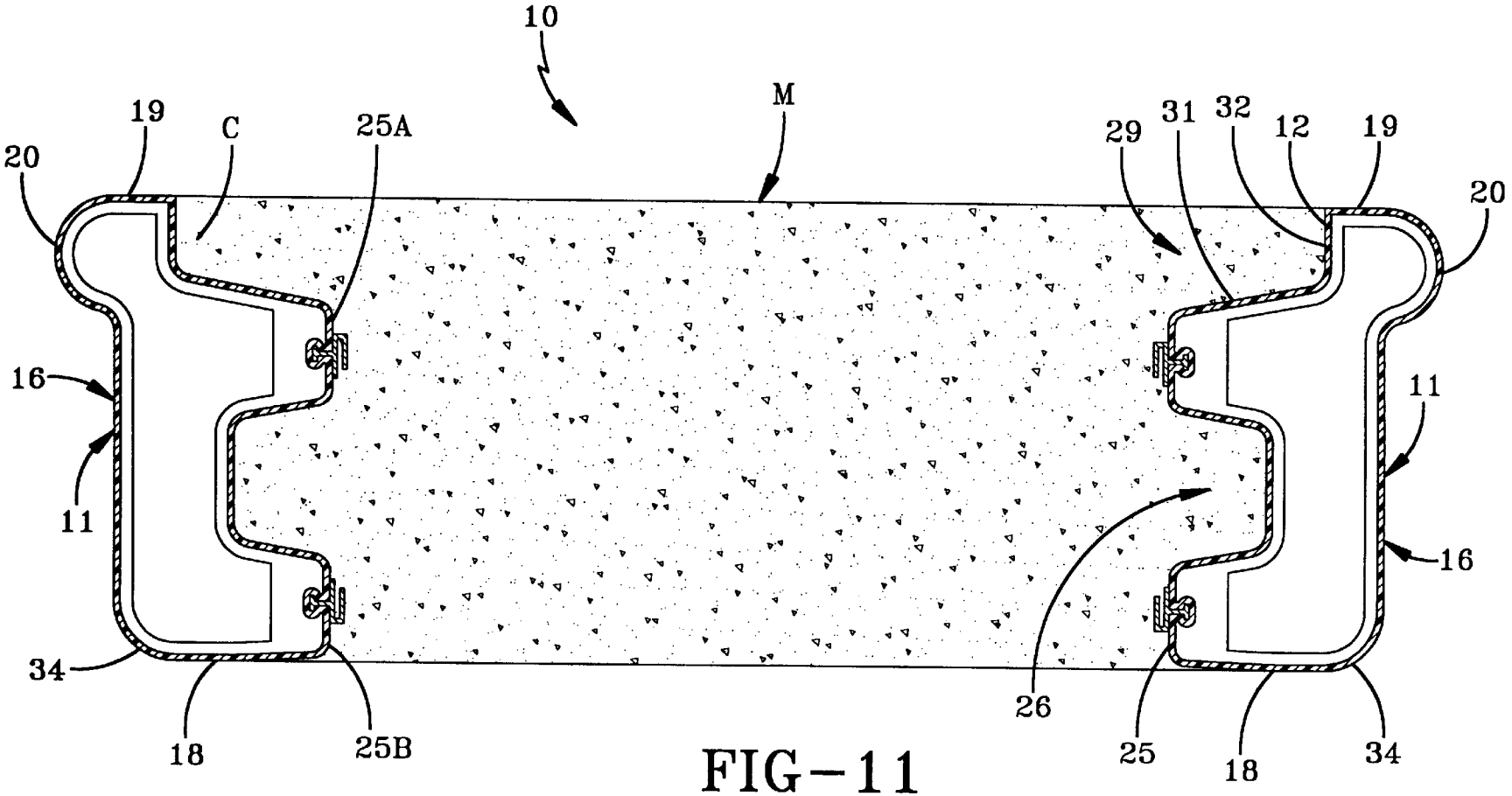
FIG. 11 is a cross-sectional view of a form according to the present invention as might be seen along line 11—11 of FIG. 1 showing the form filled with a formable building material.

As best shown in FIG. 10, tab 60 is shaped to generally conform to the receiver 55 and one or more tabs 60 may be formed or attached to the rail 50 for purposes of securing the rail 50 to the form 10. In FIG. 9, the rail 50 is formed with a single tab 60 extending substantially the entire length of the rail 50. This tab 60 is slidably inserted within the receiver 55. To correspond with the T-shaped recess 56, tab 60 includes a neck portion 61 that extends outwardly from a backing member 62 of the rail 50, which may extend toward the horizontally extending center line of the segment to a greater extent than the face member 63. The neck portion 61 extends generally perpendicular to the backing member 62 conforming substantially to the gap defined by the mouth portion 57 of recess 56. A head portion 64 extends laterally outwardly on either side of the neck portion 61 forming a generally T-shaped tab 60. Like neck portion 61, the head portion 64 generally conforms to the dimensions of the base portion 58 such that the tab 60 fits snugly within the rail receiver 55. Thus, in response to a force attempting to pull the rail 50 inward away from the form 10, the interior surfaces 65, 65 of the tab 60 engage the wall 66 of receiver 55 to prevent the rail 50 from being pulled from the form 10. As an alternative to fastening, the rails 50 may be integrally formed into one or more of the segments.

As previously mentioned, the individual segments 11, 13 may be attached in various combinations to create a selected cavity C, as desired or necessary to the individual application. Segments 11, 13 may be attached using the male and female interlocking method described above. To further secure the male female connection or as an alternative thereto, mechanical devices or fasteners may be used. To that end, any of the numerous fasteners commercially available including traditional fasteners, such as screws, bolts, nuts, and rivets, and deformable fasteners, such as, expandable clips, plastic rivets, or Christmas trees may be used to join adjacent sections. In addition to these techniques, segments may be fastened as follows.

Figure 15:
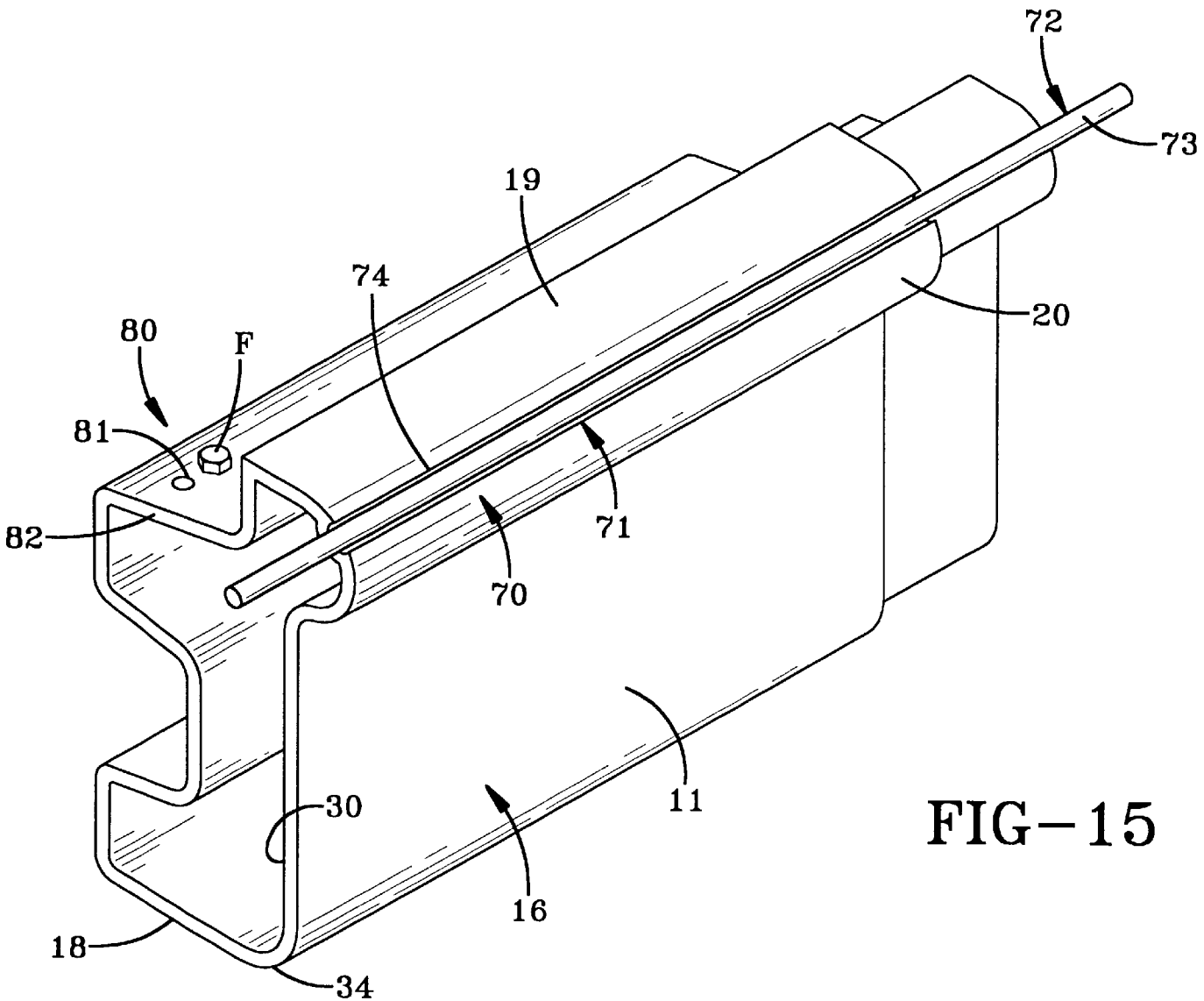
FIG. 15 is a perspective view of a segment according to the present invention depicting details of one embodiment of a segment coupling assembly and a lighting assembly.

A segment coupling assembly, generally indicated by the numeral 80 may be provided and generally includes at least one segment coupling receiver 81. Segment coupling receiver 81 may be carried on each segment 11, 13 to provide an attachment point for joining the segments 11, 13. As shown in FIG. 15 the segment coupling receiver 81 may be one or more openings in a wall 82 of the segment 11 through which a fastener F, such as a screw, may be passed to secure adjacent segments. The openings may be formed in the male and female portions 14, 15 such that when the male portion 14 is fitted within the female portion 15 the openings on the adjacent segments align and the fastener F may be inserted therethrough. Alternatively, fastener F may be driven through adjacent segments without using a pre-made opening. It will be appreciated, however, that driving the fastener F through the adjacent segments 11, 13 will create openings in the segments, which are considered to fall within the receiver terminology.

Figure 12:
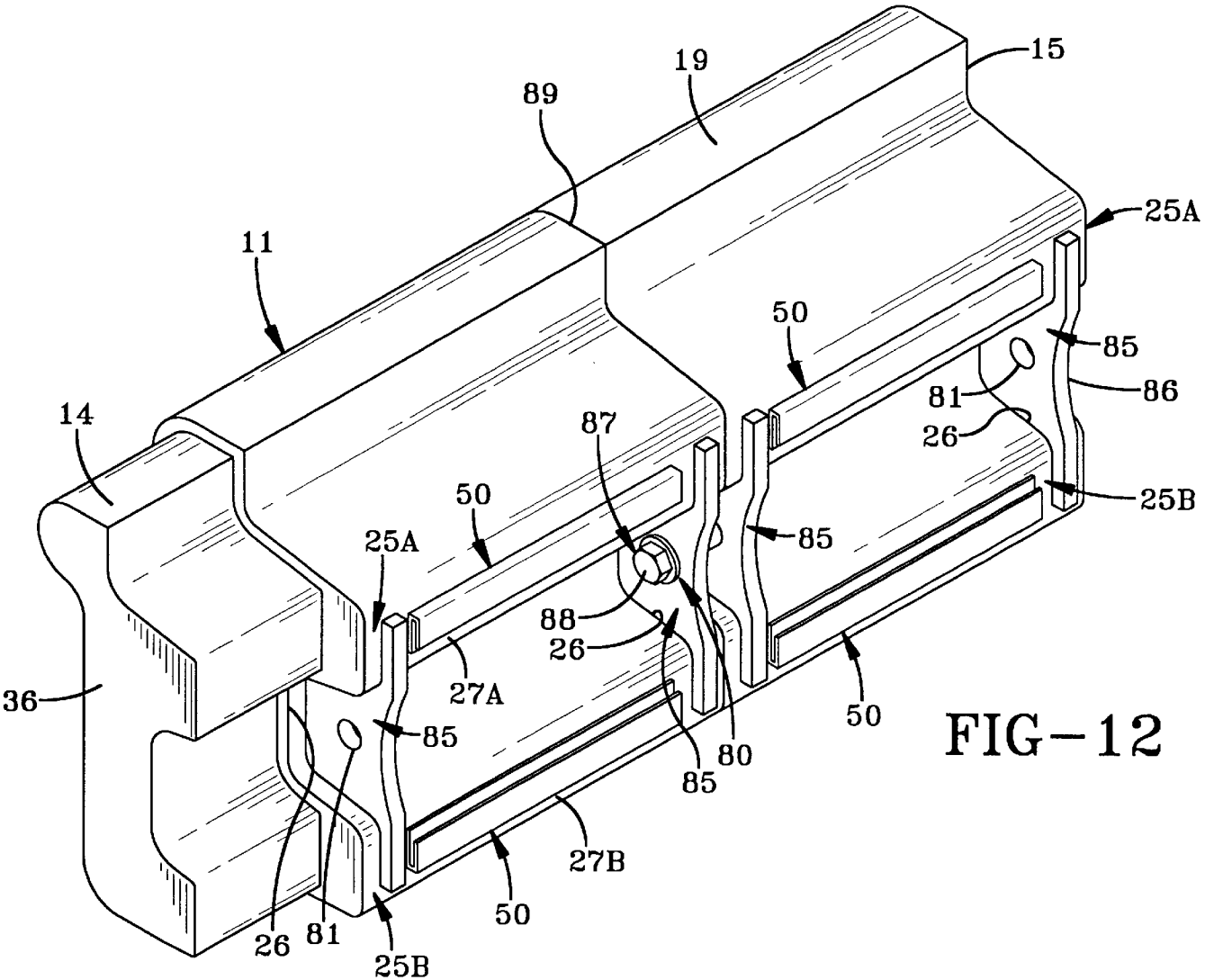
FIG. 12 is a perspective view of a pair of segments in a form according to the present invention depicting details of the attachment of one segment to the other.

Aside from forming the segment coupling receiver 81 in the wall 82 of the segments 11, 13, coupling brackets generally indicated by the numeral 85 (FIG. 12) may be formed into the segments 11, 13 or attached to the segments 11, 13. As shown in FIG. 12, a plate-like member 86 may span the well 26 between ribs 25A, 25B. A coupling member, generally indicated by the numeral 87, such as a clamp or fastener 88, such as a nut and bolt combination, may be used to apply coupling forces to the coupling bracket 86 on respective segments 11, 13 and hold the segments 11, 13 together. As shown in FIG. 12, a fastener 88 may fasten coupling brackets 86, 86, located on either side of a segment joint 89, together. The segment coupling assembly 80 may alternatively include the locking member 40 as described above.

Figure 13:
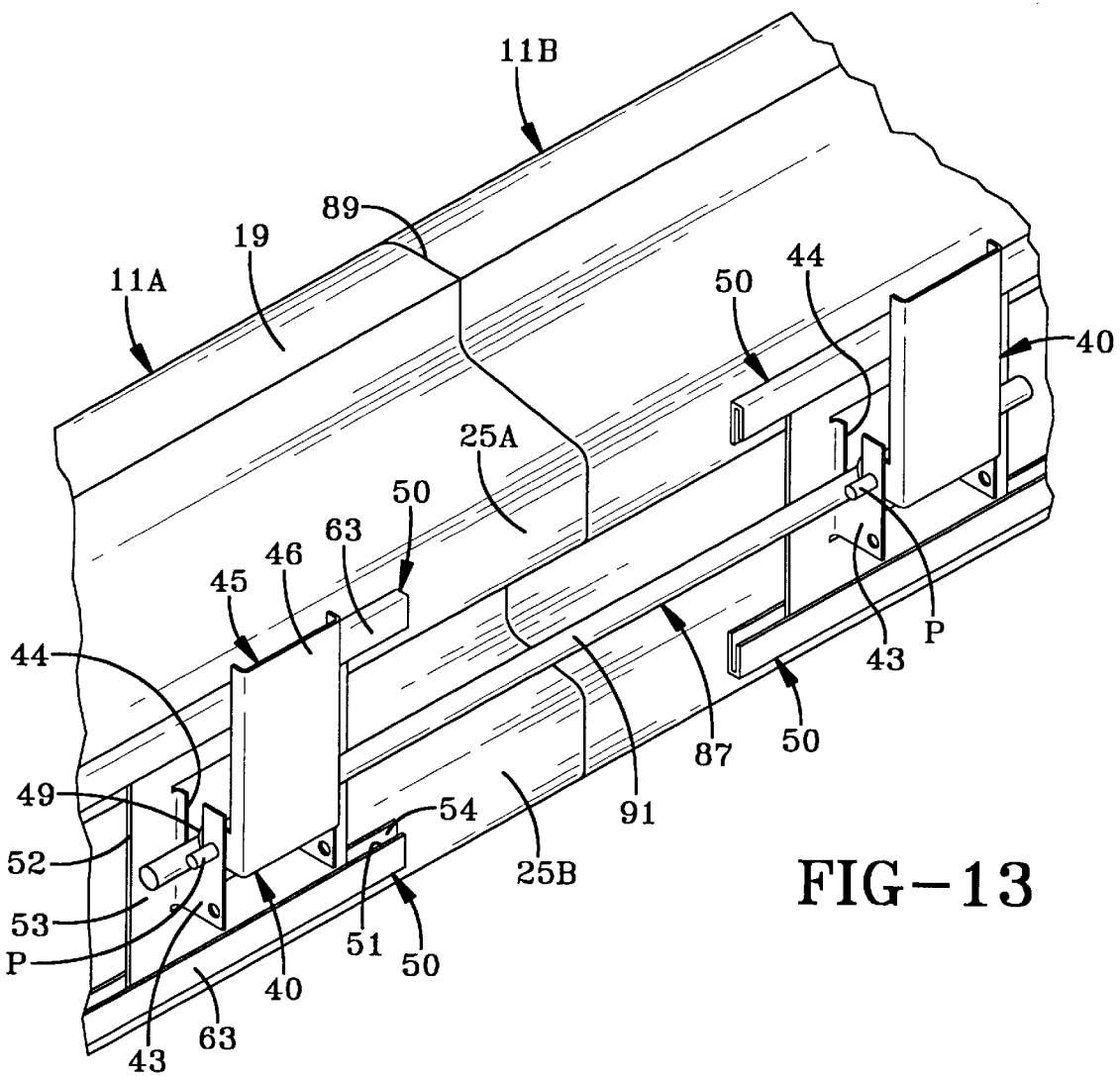
FIG. 13 is a perspective view similar to FIG. 12 depicting an alternative attachment of the segments.

With reference to FIG. 13, it will be seen that to use the locking member 40, locking member 40 is configured, as by 90° rotation, to receive a horizontally extending anchor member or coupling member 87, which may be a rod 91, as shown. In this embodiment a first locking assembly 40A located on a first segment 11A and a second locking assembly 40B located on a second segment 11B, to be coupled with first segment 11A, both receive and grasp a single rod 91 such that the segments 11A, 11B are axially fixed with respect to the rod 91 and each other.

As a final note with respect to segment coupling, coupling does not necessarily have to occur between adjacent segments 11A, 11B. Segments on either side of one or more intermediate segments may be joined and exert sufficient compressive force to hold the intermediate segments in the desired configuration to create a form cavity of proper shape and dimension.

Figure 3:
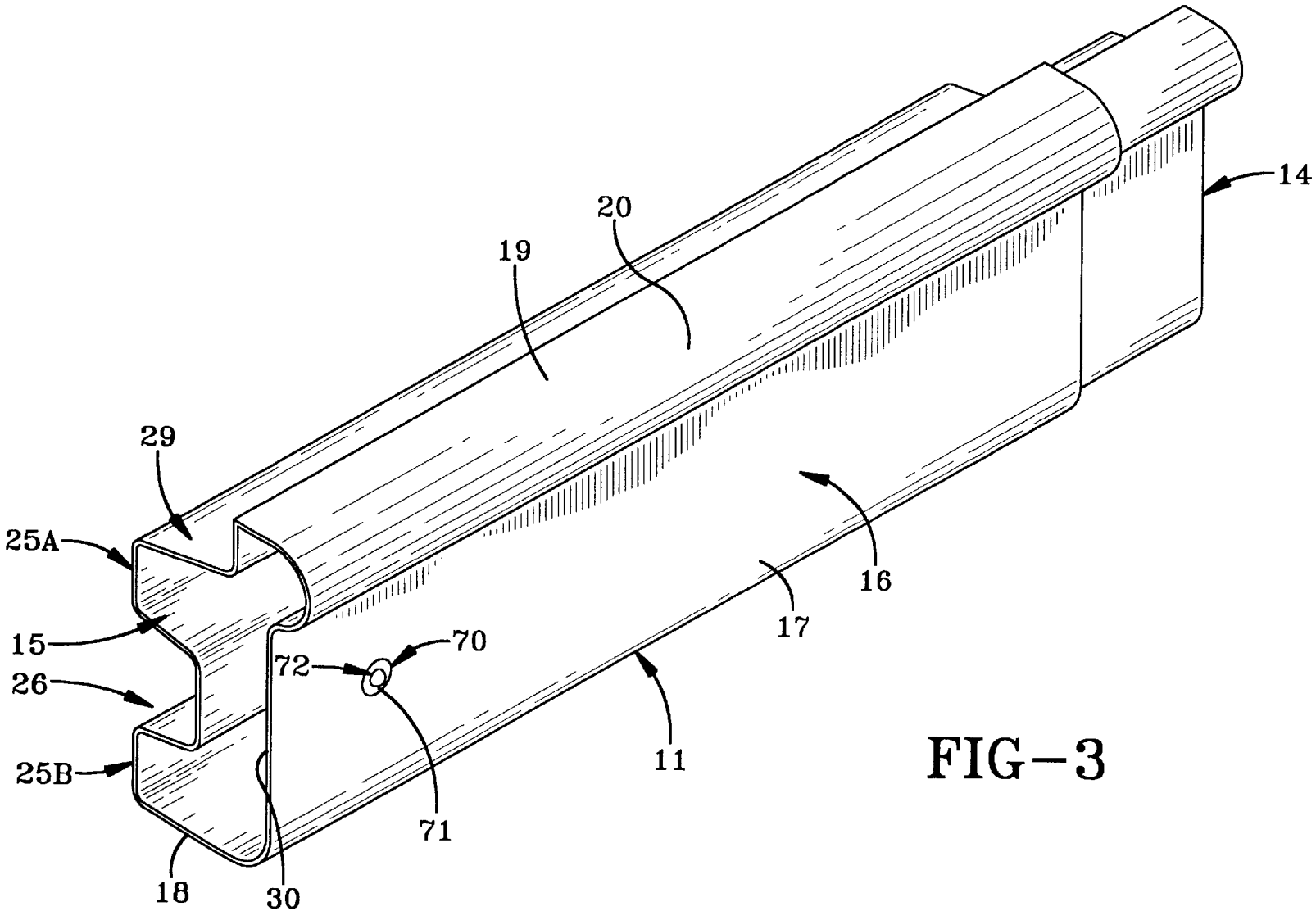
FIG. 3 is a perspective view of a segment in a form according to the present invention depicting the male and female portions of the segment used to interconnect adjacent segments in greater detail.
Figure 14:
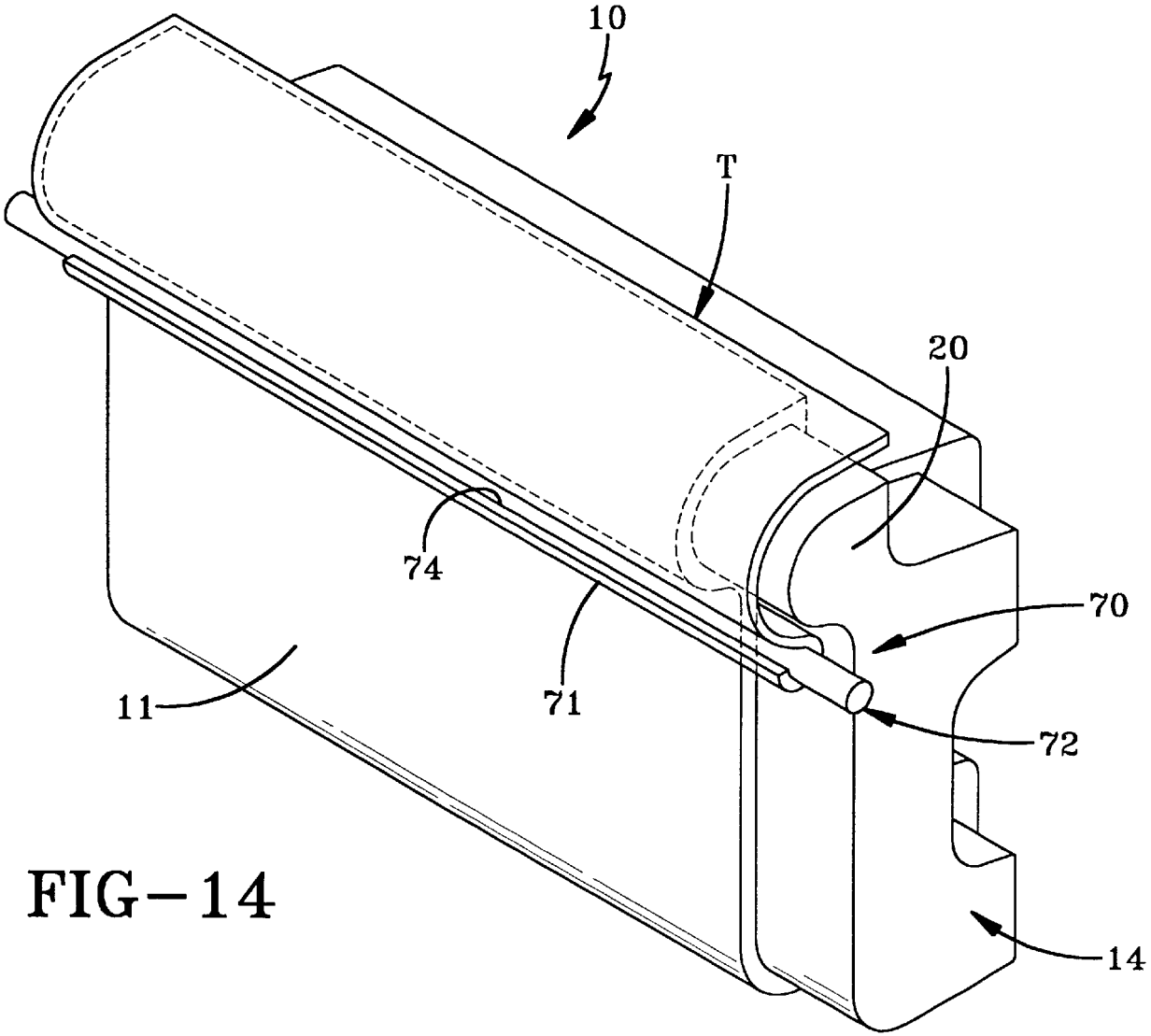
FIG. 14 is a perspective view of a segment according to the present invention depicting details of one embodiment of a segment trim strip and a lighting assembly.

Once the form 10 is in the desired position and configuration, the form 10 may be filled with formable building material M, as is generally practiced in the art. Upon doing so, the material M fills the cavity C of the form 10 including the well 26 between reinforcing ribs 25 and the recess 29 formed between the upper reinforcing rib 25A and the interior surface 32 of rim 20. As previously mentioned, to assist in leveling the material M within the form, the top surface 19 of rim 20 may be made substantially flat such that the top surface of the material M may be leveled with a float supported on the top surface 19 of form 10 and dragged across the material M. Once completed, the combination form 10 and material M is an attractive functional form having an outer surface that has increased resistence to corrosion and better wearability than steel forms presently used. The use of polymeric materials allows the form 10 to be molded in a variety of shapes and profiles for functional or aesthetic purposes. To further improve the aesthetics of the form 10 and/or improve the form's ability to function as a safety mechanism, a lighting assembly generally indicated by the numeral 70, may be attached to the form 10 or formed into form 10 and include a light receiver 71 and lights, generally indicated by the numeral 72, including individual bulbs (FIG. 3) strip lights or filamentary lumens (FIGS. 14 and 15) such as fiber-optic lights that would aid pedestrian safety and motor vehicle operation. Conveniently, the bore 30 of form 10 may be used to house the mounting hardware for these lights and the power cables connecting the lights to a power supply. In the embodiment depicted in FIG. 15, lighting assembly 70 includes a peripheral recess on the form 10 that receives a filamentary lumen 73. FIG. 15 shows a single segment having a portion of the peripheral notch 74 shown formed in the rim 20 of the form 10. It will be appreciated that the lighting assembly 70 may be placed at other locations on the exterior surface 16 of the form including the top portion 19. Alternatively, as shown in FIG. 3, form 10 may have a receiver 71 in the form of a socket for an individual bulb 72. As a further alternative, the light assembly 70 may simply include a reflective strip.

To further improve aesthetics or safety, other objects may be attached to the form 10 such as a trim strip T. Trim strip T may also provide for the attachment of lighting assembly 70 and may include an integrally formed receiver 74, such as a clip or recess, for this purpose.

In light of the foregoing, it will be appreciated that a new and useful form for moldable building material structures has been disclosed in accordance with the patent laws. It will further be appreciated that various modifications may be made to the disclosed invention without deviating from the spirt thereof, and thus, to determine the appropriate scope of the invention, reference should be made to the following claims.

What is claimed is:

1. A permanent form for receiving formable building material to create a structure, the permanent form comprising:

a plurality of polymeric segments, wherein a portion of at least one of said segments defines a female end, said female end defining a bore;

wherein a portion of at least one of said segments forms a male end that substantially conforms to said bore, said male end having a reduced dimension relative to the remainder of said segment, whereby said male end is receivable in said bore of said female end to interlock said segments;

wherein said segments are provided with a reinforcing profile, said segments having an outer surface and an inner surface, wherein said inner surface includes at least one reinforcing rib; and a rim formed, on said segments and at least partially overhanging said outer surface of said segments, said rim being located above said rib, whereby when said form is filled, a layer of material fills the recess.

2. The form of claim 1, further comprising a light receiver formed in the outer surface of at least one of said segments.

3. The form of claim 2, further comprising a light connected to a power supply received in said light receiver.

4. A permanent form for receiving formable building material to create a structure, the permanent form comprising:

a plurality of polymeric segments, wherein a portion of at least one of said segments defines a female end, said female end defining a bore; and wherein a portion of at least one of said segments forms a male end that substantially conforms to said bore, said male end having a reduced dimension relative to the remainder of said segment, whereby said male end is receivable in said bore of said female end to interlock said segments;

wherein said segments have a pair of ribs formed therein, said ribs being axially spaced from each other defining a well therebetween, each of said ribs having an inner rib wall, where said inner rib walls lie in the same vertical plane; and a first rail and a second rail supported on respective first and second inner rib walls, said rails each defining an open ended slot said open ends of said rails facing one another.

5. The form of claim 4, further comprising an anchor bracket, wherein said anchor bracket comprises a generally planar base mounted within said slots formed in said first and second rails, having a pair of arms extending inwardly from said generally planar base, a pair of slots defined in said arms adapted to receive an anchor member and a lock assembly including a lever arm pivotally attached to said bracket arms by a pair of lock arms extending toward the base of the anchor bracket, said lock arms having a lock edge adapted to selectively entrap said anchor member within said slots.

6. A permanent form for formable building material structures, the permanent form comprising:

a plurality of hollow polymeric segments coupled to one another to define a cavity;

said segments including a plurality of hollow ribs extending inwardly into said cavity, wherein each of said ribs tapers inward as it extends into said cavity and terminates in an inner rib wall, each of said inner rib walls defining a rail receiver including a recess having a mouth opening outwardly of said inner rib wall and a base portion housed within said rib, wherein said mouth is sized smaller than said base portion.

7. The form of claim 6, further comprising a rail supported on said inner rib walls by at least one tab extending from said rail and adapted to be received within said rail receiver.

8. The form of claim 6, wherein at least one rib terminates in a vertically extending inner rib wall, said rib defining a trapezoidal rib profile.

9. A permanent form used in connection with formable building material to form a structure, the permanent form comprising:

a plurality of polymeric segments coupled to one another to define a cavity;

a pair of metal rails mounted on said segments within said cavity, said rails having opposed open ended slots formed therein;

an anchor assembly including an anchor bracket and an anchor member, said anchor bracket being slidably mounted on said rails and defining a receiver in which said anchor member is received; and a locking member adapted to selectively entrap said anchor member within said receiver.

10. The form of claim 9, wherein said anchor bracket includes a pair of arms extending inward from said bracket, each arm defining a receiver for receiving said anchor member; and wherein said locking assembly includes a lever arm having a pair of lock arms extending outward from said lever arm adjacent said arms of said anchor bracket, wherein said lever arm is pivotally attached to said anchor bracket and said lock arms are rotatable to close said receivers and entrap said anchor member.

* * * * *